United States Patent [19]

Christ et al.

[11] Patent Number: 4,721,154

[45] Date of Patent: Jan. 26, 1988

[54] METHOD OF, AND APPARATUS FOR, THE CONTINUOUS CASTING OF RAPIDLY SOLIDIFYING MATERIAL

[75] Inventors: Alfred Christ, Zurich; Rolf Lehmann, Rudolfstetten; Hans-Wlater Schlaepfer, Rickenbach, all of Switzerland

[73] Assignee: Sulzer-Escher Wyss AG, Zürich, Switzerland

[21] Appl. No.: 24,425

[22] Filed: Mar. 11, 1987

[30] Foreign Application Priority Data

Mar. 14, 1986 [CH] Switzerland ..... 01052/86

[51] Int. Cl.[4] ..... B22D 11/06; B22D 11/16; B22D 11/22

[52] U.S. Cl. ..... 164/452; 164/455; 164/463; 164/479; 164/423; 164/429; 164/154; 164/414

[58] Field of Search ..... 164/463, 485, 479, 423, 164/429, 443, 452, 453, 455, 154, 155, 414

[56] References Cited

FOREIGN PATENT DOCUMENTS 2160806 1/1986 United Kingdom ..... 164/463

*Primary Examiner*—Kuang Y. Lin

*Attorney, Agent, or Firm*—Werner W. Kleeman

[57] ABSTRACT

During the melt spinning process for producing metal foils having an amorphous structure, molten metal is cast through a slot-like nozzle onto a surface or wall which is rapidly moved past the nozzle. A particularly rapid quenching and cooling rate of the solidifying melt is achieved by providing cooling support elements which are supplied with a cooling pressure medium, on one side of the moved surface or wall and which aide is located opposite to or remote from the nozzle. Advantageously, the surface or wall is constructed as a thin-walled cylindrical shell or tube which is elastically deformable to some extent. In its shell interior, there are provided a number of rows of cooling support elements which may be controlled by thickness sensors and temperature profile sensors. There is thus rendered possible, the continuous production of amorphous metal foils.

32 Claims, 3 Drawing Figures

METHOD OF, AND APPARATUS FOR, THE CONTINUOUS CASTING OF RAPIDLY SOLIDIFYING MATERIAL

BACKGROUND OF THE INVENTION

The present invention relates to a new and improved construction of a method of, and apparatus for, continuously casting rapidly solidifying material.

In its more particular aspects, the present invention specifically relates to a new and improved method of, and apparatus for, continuously casting rapidly solidifying material and which method and apparatus uses a slot-like nozzle through which the hot liquid material flows to a cooled surface or wall which is moved past the slot-like nozzle at a close spacing. The movable cooled surface or wall is made of a material having high heat conductivity. The material cast onto the movable cooled surface or wall solidifies on such surface or wall and is detached from the movable cooled surface or wall after movement through a predetermined distance.

Such apparatus as known, for example, from U.S. Pat. No. 4,142,571, granted March 6, 1979, and European Pat. No. 2,785 makes use of a process known, for example, from the technical journal "Zeitschrift für Metallkunde", Vol. 64, pgs. 835 to 843, 1973, under the designation "Melt Spin Process". This process, in turn, is based on ideas which have originated from Sir Henry Bessemer, E. H. Strange and C. A. Pim.

Such a process is particularly suitable for manufacturing foils of metals or alloys, optionally with the addition of fine non-metallic particles. Such foils possess an extremely fine-grain or amorphous, glass-like structure which cannot be obtained using conventional casting processes. In order to obtain this structure and the novel material properties associated therewith, it is necessary for the melt to extremely rapidly solidify on the moving cold or cooled surface or wall, i.e. at an extremely high cooling rate of at least $10^4$, preferably approximately $10^{6°}$ C./sec, before the solidified foil is detached from the cooled surface or wall by means of a suitable detaching device or under the action of a centrifugal force and is then passed on for further use or processing.

Due to the high heat input into the moving cooled surface or wall, the first known melt spin apparatuses were heat capacity of the moving cooled surface or wall was only suitable for discontinuous operation during which the sufficient to absorb the amount of heat of a produced charge. In order that the delivered heat may be absorbed quite well, the moving cooled surface or wall is made of a highly heat-conductive material, preferably copper or an alloy such as beryllium/copper.

In order to maintain a continuous operation, it would be necessary to cool the moving surface or wall in the most effective manner possible. However, only a small amount of heat can be removed in the case of cooling by means of gas flows which are blown onto the wall surface. Cooling by means of water or other liquids on the wall surface at which the melt solidifies, easily leads to contamination of the wall surface. Such contamination impedes or even renders impossible the casting operation. In addition, adjustability or variability of the cooling across the width of the moving surface or cooled wall neither was possible nor recognized as being desirable.

A further problem which results during the production of particularly wide foils, is associated with the thickness constancy of the produced foils. Experience has shown that already in the case of comparatively narrow foils, there is a tendency towards thickening of the edges or rim portions. It has been attempted in known apparatuses to achieve uniform thickness by maintaining specific gap or nozzle gap dimensions and gap or nozzle gap spacings from the moving cooled surface or wall. However, using such arrangement, there could not be achieved any possibility of correcting foil thickness deviations and maintaining predetermined desired thickness values during a continuously operating process.

European Pat. No. 8,901 which is cognate to U.S. Pat. No. 4,193,440, granted Mar. 18, 1980, and French Pat. No. 2,307,599 which is cognate to U.S. Pat. No. 4,061,178, granted Dec. 6, 1977, and U.S. Pat. No. 4,190,103, granted Feb. 26, 1970, describe strip or band casting means for low-melting metals. Therein, the melt is introduced into the gap formed between two water-cooled metal strips or bands. The two strips or bands are pressed against one another by pairs of cooling support elements only at a predetermined distance following the melt feeding location as viewed in the direction of movement. In this arrangement, however, the melt cooling rate is insufficient for forming a metal foil having an amorphous structure.

European Pat. No. 41,277 which is cognate to U.S. Pat. No. 4,434,836, granted Mar. 6, 1984, describes a casting process during which the molten metal or melt is poured into a groove formed on the inside of a metal cylinder which is cooled on the outside by means of cooling water nozzles at a predetermined distance following the feeding location. In this construction, again the cooling rate is insufficient for producing an amorphous structure. No thickness regulation is provided.

Furthermore, U.S. Pat. No. 3,712,366, granted Jan. 23, 1973, describes a metal casting process during which the molten metal or melt is solidified on the outer surface of a cylinder which is cooled by water which is uniformly propelled onto the entire inside of the cylinder under the action of centrifugal forces. The cooling rate which can be achieved in this arrangement, once again is insufficient for forming amorphous metal structures. Also in this construction no thickness regulation is provided.

In the continuous casting process described in French Pat. No. 2,347,999 which is cognate to U.S. Pat. No. 4,091,862, granted May 30, 1978, the metal melt is passed between two guide plates which are cooled on the outside using cooling support elements. Also in this construction, the solidification rate is not sufficiently high.

SUMMARY OF THE INVENTION

Therefore with the foregoing in mind, it is a primary object of the present invention to provide a new and improved method of, and apparatus for, continuously casting a rapidly solidifying material and which do not exhibit the aforementioned drawbacks and shortcomings of the prior art.

A more specific object of the present invention is directed to providing a new and improved method of, and apparatus for, continuously casting a rapidly solidifying material and which are devised such that there is provided intense and sufficient cooling in order to permit casting amorphous metal foils at increased foil speeds.

A further important object of the present invention aims at providing a new and improved method of, and apparatus for, continuously casting a rapidly solidifying material and which permit cooling adjustment substantially across the width of the cast material foil and, simultaneously, compensation for deviations of the foil thickness from a predetermined desired thickness value.

Yet a further significant object of the present invention aims at providing a new and improved construction of an apparatus for continuously casting a rapidly solidifying material and which apparatus is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that, the movable cooled surface or wall is constructed such as to be elastically flexible to a predetermined extent. The movable cooled surface or wall is cooled directly opposite the nozzle on the side which is remote from the nozzle. Cooling is effected by means of at least one cooling support element which is displaceable along a supporting direction extending substantially perpendicular to the movable cooled surface or wall. The cooling support element is provided with at least one bearing surface supplied with a cooling pressure fluid or medium which cools the movable cooled surface or wall. The at least one cooling support element is supported at a stationary traverse or cross-member.

The at least one cooling support element thus is arranged directly at the movable cooled surface or wall on the opposite side but at the same location at which the molten material or melt is fed onto the movable cooled surface or wall. Due to this arrangement, there is effected a particularly intense cooling and an extremely high cooling rate.

Advantageously, the at least one cooling support element is supported at the stationary traverse or cross-member by means of a pressure chamber which is supplied with a cooling pressure fluid or medium. At the bearing surface, the at least one cooling support element contains at least one pressure pocket connected to the pressure chamber via at least one throttle bore. The cooling pressure fluid or medium thus is directly concentrated at the location at which the molten metal or melt is applied or fed to the movable cooled surface or a wall.

Advantageously, a predetermined number of cooling support elements are arranged in juxtaposed relationship substantially transversely to a predetermined direction of movement of the moveable cooled surface or wall on the wall or surface side which is remote from the slot-like nozzle. The cooling support elements are individually displaceable along a support direction extending perpendicular to the moveable cooled surface or wall. These juxtaposed cooling support elements can be separately supplied with the cooling pressure fluid or medium having a controllable pressured the juxtaposed cooling support elements also can be supplied with the cooling pressure fluid or medium via a common pressure line or conduit and controllable valves or throttle valves each of which is associated with one of the cooling support elements. When the movable cooled surface or wall constitutes an elastically flexible surface or wall, there can thus not only be varied the cooling action at the individual cooling support elements but, due to the easy deformation of the movable cooled surface or wall, also the spacing of the movable cooled surface or wall from the slot-like nozzle and conjointly therewith, also the outflowing mass and local foil thickness or the thickness profile across the width of the foil.

Particular constructional advantages are provided in a preferred construction, in which the elastically flexible movable cooled surface or wall is constructed as a relatively thin-walled substantially cylindrical shell or tube which is held at both sides or ends by means of end plates and which is rotatably mounted at the stationary traverse or cross-member by means of appropriate bearings. For this purpose, there are provided seals which seal the interior or interior space of the substantially cylindrical shell or tube from the bearing and the bearing from the outside. Suitable drive means are provided for driving the substantially cylindrical shell or tube. Since the end plates cause some local stiffening of the substantially cylindrical shell or tube, the usable working width, i.e., the foil width, is somewhat smaller than the total shell or tube width as viewed in the axial direction thereof.

In order to achieve particularly intense cooling, there are advantageously provided within the interior space of the substantially cylindrical shell or tube, a predetermined number of rows of cooling support elements and which rows are aligned in the axial direction of the substantially cylindrical shell or tube. Optimum cooling is obtained when the rows of cooling support elements are distributed over the entire internal circumference of the substantially cylindrical shell or tube.

The arrangement of a predetermined number of cooling support elements in juxtaposed relationship substantially transverse to the movement of the cast material foil or web in combination with the individual control of such cooling support elements renders possible regulating the cooling and the spacing of the movable cooled surface or wall from the slot-like nozzle by controlling the cooling fluid or medium pressure at the individual cooling support elements using suitable thickness sensors. Such thickness sensors continuously detect the foil thickness profile of the run-off or detached outgoing section of the foil and supply corresponding control signals for controlling the cooling fluid or medium pressure using suitable regulating means or a computer. In addition, temperature sensors can be provided substantially transverse across the cast material foil or web and can control an other row of cooling support elements such that there is formed a desired temperature profile across the width of the cast material foil or web.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
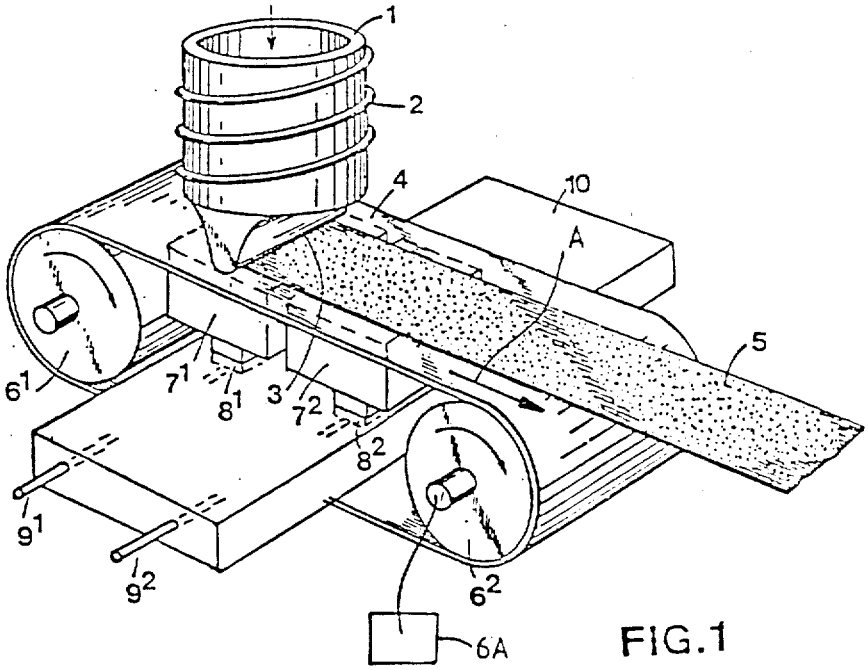
FIG. 1 shows a perspective view of a first exemplary embodiment of the inventive continuous casting apparatus.

Describing now the drawings, it is to be understood that to simplify the showing thereof, only enough of the structure of the continuous casting apparatus has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a container 1 which is supplied with molten metal and wherein the molten metal is heated by means of a high-frequency induction coil 2 to a temperature approximately 100° C. above the melting point of the metal. The hot molten metal flows, if desired, under the action of some pressure through a slot-like nozzle 3 onto a cooled surface or wall 4 which is rapidly moved substantially transverse to the direction of the slot-like nozzle 3 in a predetermined direction A of movement. At the top surface or face of the movable or moving cooled surface or wall 4, the metal melt is quenched and solidifies to form a thin cast strip or band or foil 5, which is detached from the movable or moving cooled surface or wall 4 after traveling a given cooling distance.

In order to produce an amorphous or extremely fine-grain metal band or foil 5, the slot-like nozzle 3 is constructed in a known manner such as to have a slot width of a few tenths of a millimeter and a distance d of a few tenths of a millimeter from the movable or moving cooled surface or wall 4. In the case of a surface or wall movement speed in the range of about 2 to about 50 m/sec, for example, in the range of about 10 to about 20 m/sec, there can be produced bands or foils 5 having a thickness in the range of about 20 to about 50 micrometers and a width in the decimeter to meter range.

In the illustrated embodiment, the moveable cooled surface or wall 4 is constructed as an endless belt guided around two rolls $6^1$ and $6^2$ and driven using drive or moving means 6A. The movable cooled wall or belt 4 is made of a suitable material and has a wall thickness such that it is deformed in the elastic range on revolving. The material is also selected such as to have the best possible heat conductivity. When processing, for example, aluminum or alloys having a melting point in the region of about 1100° C., copper or a copper/beryllium alloy has proved to be a particularly suitable material for the movable cooled wall or belt 4. When processing materials having higher melting points, another suitable material must be selected for the movable cooled wall or belt 4.

For producing an amorphous structure in the metal phase or even only an extremely fine-crystalline structure, decisive importance is attached to the quenching or cooling rate of the molten metal or melt. An amorphous structure; generally can only be obtained if this cooling rate is at least $10^6$° C./sec. In order to achieve such extremely high cooling rate, a hydrostatic cooling support element $7^1$ is provided directly opposite the slot-like nozzle 3 on one side of the movable cooled wall or belt 4 and which side is remote from the slot-like nozzle 3. For improving the cooling action there is provided a further cooling support element $7^2$ which follows the aforementioned cooling support element $7^1$ as viewed in the predetermined direction A of movement of the movable cooled wall or belt 4.

Cooling pressure fluid means $8^1$, $9^1$ and $8^2$ and $9^2$ are provided for displacing the cooling support element $7^1$ and the further cooling support element $7^2$ along a predetermined support direction F which extends substantially perpendicular to the movable cooled wall or belt 4. Such displacement is effected under the action of a preselected cooling pressure fluid or medium which is supplied to the cooling support elements $7^1$ and $7^2$ using the associated pressure fluid means $8^1$, $9^1$ and $8^2$ and $9^2$. The cooling support elements $7^1$ and $7^2$ are respectively supported at pressure chambers $8^1$ and $8^2$ provided in a stationary traverse or cross-member 10 which is passed substantially transversely through the movable cooled wall or belt 4. The pressure chambers $8^1$ and $8^2$ of the pressure fluid means $8^1$, $9^1$ and $8^2$ and $9^2$ are supplied, via respective lines or conduits $9^1$ and $9^2$ of the pressure fluid means $8^1$, $9^1$ and $8^2$ and $9^2$, with a pressurized cooling fluid or medium such as water which may contain any desired additive. On the side facing the underside of the movable cooled wall or belt 4, the cooling support elements $7^1$ and $7^2$ are respectively provided with hydrostatic bearing surfaces which are connected to the pressure chambers $8^1$ and $8^2$ by means of throughbores through which the cooling pressure fluid or medium is passed onto the underside of the movable cooled wall or belt 4. Appropriately, the exiting cooling pressure fluid or medium is kept away from the top surface of the movable cooled wall or belt 4 by suitable means.

The cooling fluid or medium acts upon the movable cooled wall or belt 4 which is made of the highly heat-conductive material, directly opposite the location where the hot molten metal or melt is applied or fed to the movable cooled wall or belt 4. The cooling action is uninterruptedly continued in the predetermined direction A of travel of the movable cooled wall or belt 4. Consequently, the herein described apparatus permits a continuous melt spin process at the distinctly increased cooling rate above $10^6$ ° C./sec. Using this apparatus, a number of alloys of the elements iron, nickel, cobalt, aluminum, molybdenum, chromium, vanadium, boron, phosphorus, silicon and others could be processed to yield continuously cast bands or foils 5 having a thickness in the range of about 20 to about 50 micrometers a substantially completely amorphous structure and unusual properties. The thickness of the continuously cast bands or foils 5 can be controlled during the continuous casting operation by controlling the cooling fluid or medium pressure and thus the variable spacing d between the movable cooled wall or belt 4 and the slot-like nozzle 3.

Figure 2:
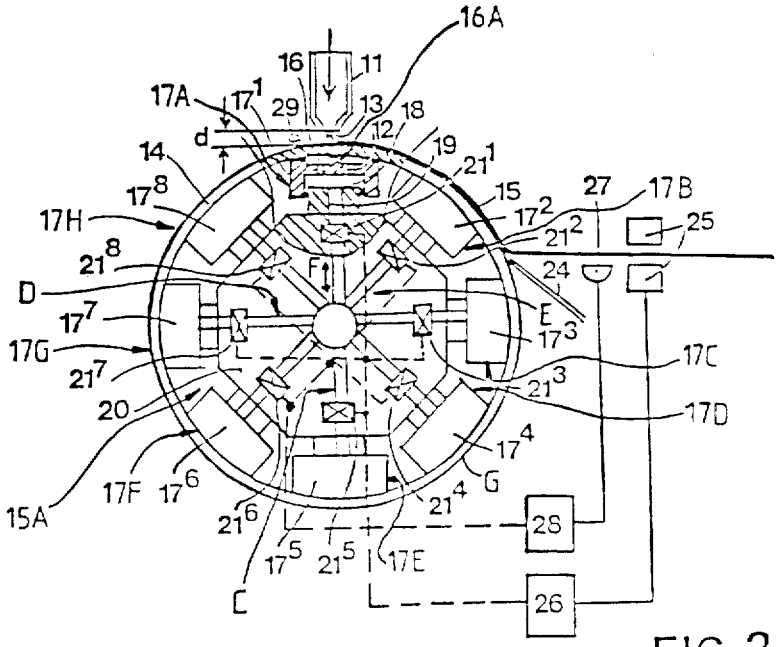
FIG. 2 shows a cross-section through a second exemplary embodiment of the inventive continuous casting apparatus.
Figure 3:
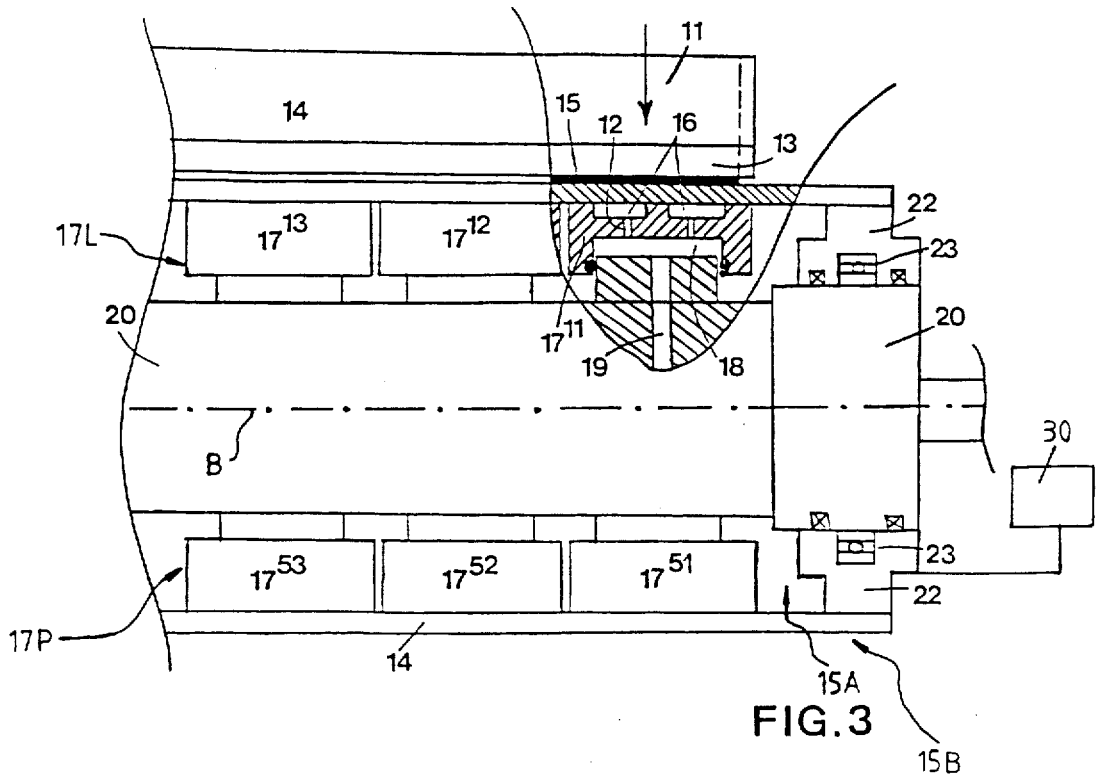
FIG. 3 shows a longitudinal section through the apparatus shown in FIG. 2.

FIGS. 2 and 3 show a particularly advantageous and preferred construction of a melt spin apparatus in which the movable cooled wall or belt 4, which is moved rapidly past a slot-like nozzle 13 of a container 11 containing the molten metal, is constructed as a rapidly rotating substantially cylindrical shell or tube 14. The diameter of the substantially cylindrical shell or tube 14 may be selected in the order of magnitude of a few decimeters and its rotational speed may be selected in the order of magnitude up to about 50 revolutions per second so that there results a movement speed up to about 30 m/sec. For the material of the substantially cylindrical shell or tube 14, there is again selected a metal having a particularly high heat conductivity, for example, copper or a copper alloy and a thickness in the range of a few millimeters so that there is provided some degree of elastic deformability.

Within the interior or interior space 15A of the substantially cylindrical shell or tube 14, there is provided a stationary traverse or cross-member 20 at which there are supported, as viewed in the rotational direction of the substantially cylindrical shell or tube 14, a predetermined number of rows 17A to 17H of cooling support elements $17^1$ to $17^8$ each of which is supported by means of an associated pressure chamber 18. In the illustrated embodiment, the rows 17A to 17H of the cooling support elements $17^1$ to $17^8$ are distributed along the inner circumference G of the substantially cylindrical shell or tube 14. On the side facing the inside or interior space 15A of the substantially cylindrical shell or tube 14, as shown by the example of the first cooling support element $17^1$, the cooling support elements $17^1$ to $17^8$ are respectively provided with hydrostatic bearing pockets 16 which are connected to the respective pressure chambers 18 by means of associated throttle bores 12. In the illustrated embodiment, each cooling support element $17^1$ to $17^8$ contains two bearing pockets 16 which conjointly define a bearing surface 16A. Each pressure chamber 18, in turn, is supplied with cooling pressure fluid or medium from the traverse or cross-member 20 by means of a cooling or coolant fluid or medium line or conduit 19.

Using the pressure fluid means 12, 18, 19, 21 containing the coolant fluid or medium lines or conduits 19, the pressure chambers 18 and the throttle bores 12 in conjunction with the hydrostatic bearing pockets 16, the cooling fluid or medium is passed to the inside or inner wall of the substantially cylindrical shell or tube 14 and ensures continuous cooling and heat dissipation. Also, during use of this construction, there thus results a continuous casting process having an extremely high quenching and cooling rate of the continuously cast metal layer or foil 15 which is applied to the outer surface of the substantially cylindrical shell or tube 14. Since substantially the entire inner circumference or wall of the substantially cylindrical shell or tube 14 can be provided with the aforementioned cooling support elements $17^1$ to $17^8$, the cooling action can be made still more intense so that the desired amorphous structure of the thus formed continuously cast metal band or foil 15 can be obtained with even greater reliability.

Controllable valves $21^1$ to $21^8$ of the pressure fluid means 12, 18, 19 and 21 are respectively provided for the individual cooling support elements $17^1$ to $17^8$ in the associated cooling or coolant fluid or medium supply lines or conduits 19 and enable regulating the quantity or pressure of the cooling fluid or medium which is supplied to the individual cooling support elements $17^1$ to $17^8$.

As particularly illustrated in FIG. 3, each individual row of cooling support elements can be formed by a predetermined number of individually controllable cooling support elements such as shown, for example, with reference to the top row 17L of cooling support elements $17^{11}$, $17^{12}$, $17^{13}$ and so forth and the diametrically opposite row 17P of cooling support elements $17^{51}$, $17^{52}$, $17^{53}$ and so forth. In each such row, the cooling support elements are arranged in closely juxtaposed relationship as viewed in the axial direction of the substantially cylindrical shell or tube 14.

The substantially cylindrical shell or tube 14 is provided at its ends or end regions, of which only the end or end region 15B is shown in FIG. 3, with respective end plates 22 which seal the interior or interior space 15A of the substantially cylindrical shell or tube 14 from the outside or against the external atmosphere. The end plates 22 are rotatably mounted at the respective ends or end regions of the stationary traverse or cross-member 20 by means of suitable anti-friction bearings 23. The end plates 22 are also provided with drive or moving means 30 for driving the substantially cylindrical shell or tube 14 for rotational about its axis B. By means of the end plates 22, there is prevented leakage of cooling fluid or medium from the interior or interior space 15A of the substantially cylindrical shell or tube 14 so that the cooling fluid or medium cannot pass to the outside or outer surface of the substantially cylindrical shell or tube 14 and the continuously cast band or foil 15 where the cooling fluid or medium might cause undesired reactions. Instead, any excess cooling fluid or medium is drained in a secure manner through suitable bores in the stationary traverse or cross-member 20. Furthermore, the solidification process on the outside or outer surface of the substantially cylindrical shell or tube 14 can be carried out in an inert gas atmosphere.

The provision of the number of cooling support elements $17^{11}$, $17^{12}$, $17^{13}$ and so forth in the axially juxtaposed relationship in the substantially cylindrical shell or tube 14 on the side opposite to the slot-like nozzle 13 additionally permits in a particularly favorable further developed construction, automatically regulating the thickness of the continuously cast band or foil 15 substantially across the entire width thereof. This is especially important for manufacturing or continuously casting wide or broad metal bands or foils.

For this purpose, as shown in FIG. 2, there is provided following the band or foil detachment which, for example, may be effected by means of a scraper 24 or an air jet, a predetermined number of thickness sensors 25 which are distributed substantially across the entire width of the continuously cast or produced band or foil 15. These thickness sensors 25 are connected to a regulating means or device 26 which controls the controllable valves $21^1$, $21^3$, $21^5$, and $21^7$ by means of corresponding control signals, for example, using a suitably programmed microprocessor.

The regulating means or device 26 or its program is set-up such that, in the case of an increase in the band or foil thickness measured by the thickness sensors 25, the controllable valves $21^1$ and $21^5$ which are respectively associated with the cooling support elements $17^1$ and $17^5$, are opened to some degree at the associated predetermined locations as seen in respect of the axis B of the substantially cylindrical shell or tube 14. As a consequence, a greater quantity of cooling pressure fluid or medium is supplied to the two cooling support elements $17^1$ and $17^5$. Simultaneously, the controllable valves $21^3$ and $21^7$ which are respectively associated with the cooling support elements $17^3$ and $17^7$ and which are positioned substantially perpendicularly or at right angles to the related cooling support elements $17^1$ and $17^5$, are constricted to some extent so that the pressure of the cooling fluid or medium is slightly decreased in the cooling support elements $17^3$ and $17^7$. As a result, the substantially cylindrical shell or tube 14 is slightly substantially elliptically deformed so that the gap d existing between the shell or tube 14 and the slot-like nozzle 13 is reduced to some degree at particular locations associated with the cooling support elements $17^1$ and $17^5$ and less molten metal is discharged at these locations. The band or foil thickness thus is automatically regulated to a predetermined desired thickness value.

Due to the fact that in each case two oppositely located cooling support elements, such as the cooling support elements $17^1$ and $17^5$ are influenced in substantially the same manner, there do not appear integral bending stresses affecting the substantially cylindrical shell or tube 14. Consequently, no forces are released which have to be transmitted through the lateral bearings such as the anti-friction bearings 23. Constructional complications can be reduced by supplying the cooling pressure fluid or medium in each case to two oppositely disposed cooling support elements, such as the cooling support elements $17^1$, $17^5$ and $17^3$, $17^7$ through a common controllable valve.

In the aforedescribed arrangement, the rows constitute two pairs of diametrically oppositely disposed rows 17A, 17E and 17C, 17G which respectively contain the pairs $17^1$, $17^5$ and $17^3$, $17^7$ of oppositely disposed cooling support elements $17^1$, $17^5$ and $17^3$, $17^7$ so that there are defined two orthogonal coordinate axes C and D. In order to achieve very intense cooling, there can be advantageously provided, apart from the four rows 17A, 17E and 17C, 17G of cooling support elements $17^1$, $17^5$ and $17^3$, $17^7$, further rows 17B, 17D, 17F and 17H of further cooling support elements $17^2$, $17^4$, $17^6$ and $17^8$. Such further rows 17B, 17D, 17F and 17H of the further cooling support elements $17^2$, $17^6$, $17^4$ and $17^8$ preferably are arranged in the regions of the respective angle bisectors E to the aforementioned orthogonal coordinate axes C and D and advantageously can be used for effecting a temperature regulation.

For this purpose, there is provided a system of temperature sensors 27 which determine the temperature profile substantially across the band or foil width and feed signals representing the temperature profile to a further regulating means or device 28 which also may be equipped with a suitable microprocessor. By means of such further regulating means or device 29, appropriate control pulses are fed to associated controllable valves or throttle valves $21^2$, $21^4$, $21^6$, and $21^8$ which are associated with the respective cooling support elements $17^2$, $17^4$, $17^6$ and $17^8$. The controllable valves or throttle valves $21^2$, $21^4$, $21^6$ and $21^8$ are operated in a manner such that more cooling fluid or medium is supplied to the cooling support elements located at elevated temperature locations, and less cooling fluid or medium is supplied to the cooling support elements located at lower temperature locations. Also in this case, there can be adopted the constructionally simplified circuit in which the pairs of opposite cooling support elements located in the different longitudinal planes are controlled by related common controllable valves each of which is associated with one of the different longitudinal planes. There can be further provided additional cooling support elements which are arranged, as viewed in circumferential direction, in the gaps or spaces between the aforementioned cooling support elements $17^1$ to $17^8$. Such additional cooling support elements are controlled using suitable cooling fluid or medium pressure.

Depending upon the type of continuously cast band or foil 15 to be produced, it is important that the temperature profile of the moving or movable cooled wall, i.e. the substantially cylindrical shell or tube 14 is sufficiently balanced or equalized prior to the entry into the region of the slot-like nozzle 13. Therefore, there can be provided at this location, a further temperature profile sensor system 29 which supplies corresponding signals also to the further regulating means or device 28. The program of the regulating means or device 28 in this case is appropriately selected such that there serves as the temperature control signal, a control signal which is appropriately weighted in accordance with the product of the two measuring informations or data provided by the system of temperature sensors 27 which are located following the slot-like nozzle 13 and the further system 29 of temperature sensors which are located preceding the slot-like nozzle 13, each as viewed in the predetermined direction A of movement of the substantially cylindrical shell or tube 14.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for continuously casting a rapidly solidifying material, comprising:

a substantially slot-like nozzle for infeeding a rapidly solidifying material in a hot liquid state;

a movable wall movable past said substantially slot-like nozzle at a close spacing from said substantially slot-like nozzle;

means for moving said movable wall past said substantially slot-like nozzle and in a predetermined direction of movement;

cooling means for cooling said movable wall;

said movable wall comprising a material having high heat conductivity;

the rapidly solidifying material, in the hot liquid state, flowing through said substantially slot-like nozzle onto said movable cooled wall, solidifying on said movable cooled wall and, after movement of said movable cooled wall through a predetermined distance, being detachable from said movable cooled wall in the form of a continuously cast foil;

said movable cooled wall being elastically flexible to a predetermined extent;

said cooling means containing at least one cooling support element;

said at least one cooling support element being displaceable along a predetermined support direction substantially perpendicular to said movable cooled wall;

said cooling means comprising cooling pressure fluid means for displacing under the action of a preselected cooling pressure fluid said at least one cooling support element along said predetermined support direction;

said at least one cooling support element being arranged directly opposite to said substantially slot-like nozzle and on one side of the movable cooled wall and which side is remote from said substantially slot-like nozzle;

said at least one cooling support element being provided with at least one bearing surface supplied with said cooling pressure fluid by said cooling pressure fluid means for cooling and supporting said movable cooled wall;

a stationary traverse; and said at least one cooling support element being supported at said stationary traverse.

2. The apparatus as defined in claim 1, further including:

at least one further cooling support element arranged adjacent to said at least one cooling support element as viewed in said predetermined direction of movement of said movable cooled wall; and said at least one further cooling support element being provided in addition to said at least one cooling support element on said one side of said moveable cooled wall and which side is remote from said substantially slot-like nozzle.

3. The apparatus as defined in claim 1, wherein:

said at least one cooling support element constitutes a predetermined number of cooling support elements arranged substantially transversely to said predetermined direction of movement of said movable cooled wall; and said predetermined number of cooling support elements being supplied with said cooling pressure fluid independently of each other.

4. The apparatus as defined in claim 1, wherein:

said pressure fluid means contains at least one pressure chamber for supporting said at least one cooling support element at said stationary traverse;

said at least one pressure chamber being supplied with said cooling pressure fluid;

said at least one support element containing at least one pressure pocket at said at least one bearing surface; and each said at least one pressure pocket communicating with the associated pressure chamber through a throttle bore.

5. The apparatus as defined in claim 4, wherein:

said cooling pressure fluid means contain at least one controllable valve; and said at least one controllable valve controlling at least one cooling pressure fluid supply conduit connected to said at least one pressure chamber.

6. The apparatus as defined in claim 2, wherein:

said at least one further cooling support element is supported by means of at least on pressure chamber of said cooling pressure fluid means at said stationary traverse;

said at least one pressure chamber being supplied with said cooling pressure fluid;

said at least one further support element containing at least one pressure pocket at said at least one bearing surface; and each said at least one pressure pocket communicating with said pressure chamber through a throttle bore.

7. The apparatus as defined in claim 6, wherein:

said cooling pressure fluid means contain at least one controllable valve; and said at least one controllable valve controlling at least one cooling pressure fluid supply conduit connected to said at least one pressure chamber by means of which said at least one further cooling support element is supported at said stationary traverse.

8. The apparatus as defined in claim 5, further including:

a predetermined number of thickness sensors for determining local thickness values of said continuously cast foil;

said continuously cast foil having a predetermined: width;

said predetermined number of thickness sensors being distributed across substantially said predetermined width of said continuously cast foil;

said at least one cooling support element constituting a predetermined number of cooling support elements distributed at least across substantially said predetermined width of said continuously cast foil;

each of said predetermined number of thickness sensors being operatively associated with at least one of said predetermined number of cooling support elements;

said at least one controllable valve constituting a predetermined number of controllable valves each of which controls the cooling pressure fluid supply to at least one of said predetermined number of cooling support elements;

regulating means operatively associated with said predetermined number of thickness sensors and said predetermined number of controllable valves; and said regulating means regulating local thickness values of said continuously cast foil by regulating the pressure of said cooling pressure fluid supplied to said at least one cooling support element, which is arranged on said one side of said movable cooled wall and which side is remote from said substantially slot-like nozzle, and thereby causing deformation of said elastically flexible movable cooled wall and thus a change in the quantity of the hot liquid constituting the rapidly solidifying material flowing out from said substantially slot-like nozzle.

9. The apparatus as defined in claim 7, further including:

a predetermined number of temperature sensors distributed across substantially said predetermined width of said continuously cast foil produced on said movable cooled wall;

said predetermined number of temperature sensors being provided for determining the temperature profile across substantially said predetermined width of said continuously cast foil;

said at least one further cooling support element constituting a predetermined number of further cooling support elements distributed at least across substantially said predetermined width of said continuously cast foil;

each one of said predetermined number of temperature sensors being operatively associated with at least one of said predetermined number of further cooling support elements;

said at least one controllable valve constituting a predetermined number of controllable valves each of which controls the cooling pressure fluid supply to at least one of said predetermined number of further cooling support elements;

regulating means operatively associated with said predetermined number of temperature sensors and said predetermined number of controllable valves; and said regulating means regulating said temperature profile across substantially said predetermined width of said continuously cast foil by regulating the pressure of said cooling pressure fluid supplied through said predetermined number of controllable valves to said predetermined number of further cooling support elements.

10. The apparatus as defined in claim 9, further including:

a temperature sensor system arranged precedingly of said substantially slot-like nozzle as viewed in said predetermined direction of movement of said movable cooled wall;

said movable cooled wall having a predetermined width;

said temperature sensor system extending across substantially said predetermined width of said movable cooled wall for determining the temperature profile across substantially said predetermined width of said movable cooled wall in a region preceding said substantially slot-like nozzle as seen in said predetermined direction of movement of said movable cooled wall;

said temperature sensor system being operatively associated with said regulating means; and said regulating means regulating the temperature profile across substantially the predetermined width of said continuously cast foil by regulating the pressure of said cooling pressure fluid through said predetermined number of controllable valves to said predetermined number of further cooling support elements in response to a weighted temperature signal derived from said temperature profile determined by said temperature sensors distributed across substantially said predetermined width of said continuously cast foil produced on said movable cooled wall, and from the temperature profile determined by said temperature sensor system substantially extending across said predetermined width of said movable cooled wall precedingly of said substantially slot-like nozzle as viewed in said predetermined direction of movement of said movable cooled wall.

11. The apparatus as defined in claim 1, wherein:

said movable cooled wall is constructed as a thin-walled substantially cylindrical shell defining an interior space and a circumference;

said stationary traverse being substantially centrally arranged within said interior space defined by said substantially cylindrical shell; and said at least one cooling support element constituting a predetermined number of rows of cooling support elements which are distributed across said circumference defined by said substantially cylindrical shell.

12. The apparatus as defined in claim 11, further including:

two end plates;

said substantially cylindrical shell possessing two end regions;

said two end plates respectively sealing against the external atmosphere said two end regions of said substantially cylindrical shell; and bearings for rotatably mounting said end plates at said stationary traverse.

13. The apparatus as defined in claim 8, wherein:

said movable cooled wall is constructed as a thin-walled substantially cylindrical shell defining an interior space and a circumference;

said stationary traverse being substantially centrally arranged within said interior space defined by said substantially cylindrical shell;

said predetermined number of cooling support elements constituting a predetermined number of rows of cooling support elements which are distributed across said circumference defined by said substantially cylindrical shell;

said predetermined number of rows of cooling support elements constituting two pairs of diametrically oppositely disposed rows of cooling support elements;

said two pairs of diametrically oppositely disposed rows of cooling support elements being arranged substantially perpendicular to each other;

said two pairs of diametrically oppositely disposed rows of cooling support elements being constituted by a predetermined number of two pairs of diametrically oppositely disposed cooling support elements;

each one of said predetermined number of thickness sensors being operatively associated with at least one of said predetermined number of two pairs of diametrically oppositely disposed cooling support elements;

each one of said predetermined number of controllable valves controlling the cooling pressure fluid supply to at least one pair of said diametrically oppositely disposed cooling support elements of said predetermined number of two pairs of diametrically oppositely disposed cooling support elements; and said regulating means regulating said local thickness of said continuously cast foil by regulating the pressure of said cooling pressure fluid supplied to each one of said predetermined number of two pairs of diametrically oppositely disposed cooling support elements such that the pressure supplied to one of the two pairs of diametrically oppositely disposed cooling support elements is varied oppositely to the pressure variation in the other one of said two pairs of diametrically oppositely disposed cooling support elements in order to thereby produce a substantially elliptical deformation of said substantially cylindrical shell.

14. The apparatus as defined in claim 13, wherein:

said substantially cylindrical shell defines a predetermined axial width;

said two pairs of diametrically oppositely disposed rows of cooling support elements define orthogonal coordinate axes defining four coordinate angles;

at least one further row of further cooling support elements;

said at least one further row of further cooling support elements being arranged in the region of the angle bisector bisecting at least one angle between said orthogonal coordinate axis;

a predetermined number of temperature sensors distributed across substantially said predetermined width of said continuously cast foil produced on said movable cooled wall;

said predetermined number of temperature sensors being provided for determining the temperature profile across said predetermined width of said continuously cast foil;

said at least one further row of further cooling support elements constituting a predetermined number of further cooling support elements distributed at least across substantially said predetermined width of said continuously cast foil;

each one of said predetermined number of temperature sensors being operatively associated with at least one of said predetermined number of further cooling support elements;

said cooling pressure fluid means containing a predetermined number of controllable valves each of which controls the cooling pressure fluid supply to at least one of said predetermined number of further cooling support elements;

further regulating means operatively associated with said predetermined number of temperature sensors and said predetermined number of controllable valves; and said further regulating means regulating said temperature profile across said predetermined width of said continuously cast foil by regulating the pressure of said cooling pressure fluid supplied through each one of said predetermined number of controllable valves to said at least one of said predetermined number of further cooling support elements in said at least one further row of further cooling support elements.

15. The apparatus as defined in claim 14, wherein:

said at least one further row of further cooling support elements constitutes two pairs of diametrically oppositely disposed further rows of further cooling support elements.

16. A method of continuously casting a rapidly solidifying material, comprising the steps of:

moving a movable wall at a predetermined speed through a closed travelling path in a predetermined direction of movement;

feeding to one side of said moving wall hot liquid constituting a rapidly solidifying material through a substantially slot-like nozzle which is arranged substantially transversely relative to said moving wall and at a predetermined spacing from said moving wall;

supporting said moving wall on an other side of said moving wall and which other side is remote from said substantially slot-like nozzle, and at least substantially directly opposite to said substantially slot-like nozzle by means of at least one cooling support element;

passing a cooling fluid through said at least one cooling support element in order to support and cool said moving wall and said hot liquid constituting the rapidly solidifying material passed through said substantially slot-like nozzle to said one side of said moving wall and thereby continuously casting a foil of said rapidly solidifying material on said one side of said moving wall;

displacing under the action of said cooling fluid said at least one cooling support element along a predetermined support direction such that there is obtained an appropriate spacing between said substantially slot-like nozzle and said movable wall and detaching said foil of said rapidly solidifying material from said one side of said moving wall at a predetermined detachment location downstream of said substantially slot-like nozzle as viewed in said predetermined direction of movement of said moving wall.

17. The method as defined in claim 16, wherein:

during said step of feeding said hot liquid constituting the rapidly solidifying material onto said one side of said moving wall, feeding a preselected metal which is heated to the molten state, onto said one side of said moving wall;

selecting as said moving wall, a wall made of a highly heat-conductive material;

during said step of supporting and cooling said moving wall, cooling said moving wall at a cooling rate of at least $10^{6}$° C./sec; and during said step of continuously casting said foil, continuously casting as said foil, a foil of said preselected metal which possesses an amorphous structure.

18. The method as defined in claim 17, further including the steps of:

selecting as said substantially slot-like nozzle, a substantially slot-like nozzle having a slot width in the range of about 0.1 to about 1.0 mm;

arranging said substantially slot-like nozzle at a spacing in the range of 0.1 to 1.0 mm from said one side of said moving wall; and said step of moving said movable wall at said predetermined speed through said closed travelling path, entailing the step of moving said moving wall at a surface speed in the range of about 2 to about 50 m/sec.

19. The method as defined in claim 16, further including the step of:

supporting said at least one cooling support element at a stationary traverse extending through said closed travelling path of said moving wall.

20. The method as defined in claim 19, wherein:

said step of passing said cooling fluid through said at least one cooling support element entails passing pressurized cooling fluid through said at least one cooling support element.

21. The method as defined in claim 20, wherein:

said step of supporting and cooling said moving wall at said at least one cooling support element includes supporting said moving wall at a bearing surface of said at least one cooling support element;

said step of supporting said at least one cooling support element at said stationary traverse including the step of supporting said at least one cooling support element by means of at least one pressure chamber formed between said at least one cooling support element and said stationary traverse; and said step of passing said pressurized cooling fluid through said at least one cooling support element including the step of passing said pressurized cooling fluid through said pressure chamber and said bearing surface.

22. The method as defined in claim 21, wherein:

said step of passing said pressurized cooling fluid through said at least one cooling support element entails passing said pressurized cooling fluid through a predetermined number of cooling support elements arranged substantially transversely to said predetermined direction of movement of said moving wall; and passing said pressurized cooling fluid independently of each other through said cooling support elements of said predetermined number of cooling support elements.

23. The method as defined in claim 21, further including the step of:

controlling the passage of said pressurized cooling fluid through said at least one cooling support element by means of a controllable valve.

24. The method as defined in claim 16, further including the steps of:

arranging said at least one further cooling support element downstream from said at least one cooling support element as viewed in said predetermined direction of movement of said movable wall;

supporting said moving wall on said other side which is remote from said substantially slot-like nozzle, by means of said at least one further cooling support element; and passing said cooling fluid through said at least one further cooling support element in order to further support and cool said moving wall and said hot liquid constituting the rapidly solidifying material passed through said substantially slot-like nozzle to said one side of said moving wall.

25. The method as defined in claim 23, further including the steps of:

determining local thickness values of said continuously cast foil by means of a predetermined number of thickness sensors distributed across substantially the width of the continuously cast foil; and regulating said local thickness values of said continuously cast foil by regulating said passage of said pressurized cooling fluid through said at least one controllable valve in response to the operation of said predetermined number of thickness sensors.

26. The method as defined in claim 24, further including the steps of:

determining the temperature profile across the width of said continuously cast foil by means of a predetermined number of temperature sensors distributed across substantially the width of said continuously cast foil;

controlling the passage of said pressurized cooling fluid through said at least one further cooling support element; and regulating said temperature profile across the width of said continuously cast foil by regulating said passage of said pressurized cooling fluid through said at least one controllable valve and said at least one further cooling support element in response to said temperature profile detected by said predetermined number of temperature sensors.

27. The method as defined in claim 26, further including the steps of:

determining the temperature profile across substantially the width of said moving wall by means of a temperature sensor system arranged precedingly of said substantially slot-like nozzle as viewed in said predetermined direction of movement of said moving wall; and said step of regulating said passage of said pressurized fluid medium through said controllable valve and said at least one further cooling support element entailing the step of regulating said passage of said pressurized fluid in response to a weighted temperature signal derived from said temperature profile determined by said temperature sensors and said temperature profile determined by said temperature sensor system.

28. The method as defined in claim 16, wherein:

said step of moving said movable wall through said closed travelling path in said predetermined direction of movement includes the step of rotating, as said movable wall, a substantially cylindrical shell about its axis;

said step of supporting said movable wall including the step of supporting said substantially cylindrical shell at a predetermined number of rows of cooling support elements which are distributed across the inner circumference of said substantially cylindrical shell; and supporting said predetermined number of rows of cooling support elements at a stationary traverse substantially centrally arranged in the interior space of said substantially cylindrical shell.

29. The method as defined in claim 28, further including the steps of:

sealing against the external atmosphere, the two ends of said substantially cylindrical shell by means of two related end plates; and rotatably supporting said two end plates at associated regions of said stationary traverse substantially centrally arranged within the interior space of said substantially cylindrical shell.

30. The method as defined in claim 25, further including the steps of:

said step of moving said movable wall through said closed travelling path in said predetermined direction of movement includes the step of rotating, as said movable wall, a substantially cylindrical shell about its axis;

said step of supporting said movable wall including the step of supporting said substantially cylindrical shell at a predetermined number of rows of cooling support elements which are distributed across the inner circumference of said substantially cylindrical shell;

supporting said predetermined number of rows of cooling support elements at a stationary traverse substantially centrally arranged in the interior space of said substantially cylindrical shell;

said step of passing said pressurized cooling fluid through said at least one cooling support element including the step of passing said pressurized cooling fluid through said predetermined number of rows of cooling support elements constituting two pairs of diametrically oppositely disposed rows of cooling support elements and which two pairs of rows are offset substantially at right angles from each other; and said step of regulating said local thickness values of said continuously cast foil by regulating the pressure of said pressurized cooling fluid supplied through said at least one controllable valve to said at least one support element including the step of regulating the pressure of said cooling pressure fluid supplied to two pairs of diametrically oppositely disposed cooling support elements of said two pairs of diametrically oppositely disposed rows of cooling support elements such that, the pressure supplied to one of the two pairs of diametrically oppositely disposed cooling support elements is varied oppositely to the pressure variation in the other one of said two pairs of diametrically oppositely disposed cooling support elements and thereby producing a substantially elliptical deformation of said substantially cylindrical shell.

31. The method as defined in claim 30, further including the steps of:

arranging at least one further cooling support element downstream from said at least one cooling support element as viewed in said predetermined direction of movement of said movable wall;

arranging said at least one further row of further cooling support elements in the region of the angle bisector between at least two adjacent rows of said two pairs of diametrically oppositely disposed rows of cooling support elements;

further supporting said movable wall on said other side which is remote from said substantially slot-like nozzle, by means of said at least one further row of cooling support elements;

passing said cooling pressure fluid through said at least one further row of cooling support elements in order to further support and cool said movable wall and said hot liquid constituting the rapidly solidifying material passed through said substantially slot-like nozzle to said one side of said movable wall;

determining the temperature profile across substantially said predetermined width of said continuously cast foil by means of a predetermined number of temperature sensors distributed across substantially said predetermined width of said continuously cast foil;

controlling the passage of said pressurized cooling fluid through said at least one further row of cooling support elements; and further regulating said temperature profile across substantially the predetermined width of said continuously cast foil by regulating the pressure of said pressurized cooling fluid supplied through said at least one controllable valve and said at least one further row of cooling support elements in response to said temperature profile detected by said predetermined number of temperature sensors.

32. The method as defined in claim 31, wherein:

said step of arranging said at least one further row of cooling support elements entails arranging two further pairs of diametrically oppositely disposed rows of cooling support elements in the regions of the angle bisectors formed between the two pairs of diametrically oppositely disposed rows of cooling support elements and which two pairs of rows are offset substantially at right angles from each other.

* * * * *

UNITED STATES PATENT AND TRADEMARK OFFICE

CERTIFICATE OF CORRECTION

PATENT NO. : 4,721,154

DATED : January 26, 1988

INVENTOR(S) : ALFRED CHRIST et al

It is certified that error appears in the above-identified patent and that said Letters Patent is hereby corrected as shown below:

Column 1, line 46, after "were" please add --only suitable for discontinuous operation during which the--

Column 1, line 47, please delete "only suitable for discontinuous operation during"

Column 1, line 48, delete "which the"

Column 3, line 51, please delete "a"

Column 3, line 62, please delete "pressured the" and insert --pressure. The--

Column 5, line 35, please delete "d" and insert --d--

Column 6, line 53, please change "d" to --d--

Column 8, line 66, please change "d" to --d--

Signed and Sealed this

Twenty-first Day of June, 1988

*Attest:*

DONALD J. QUIGG

*Attesting Officer*

*Commissioner of Patents and Trademarks*